United States Patent [19]

Mears, Jr.

[11] Patent Number: 5,076,537

[45] Date of Patent: Dec. 31, 1991

[54] ELECTROMECHANICAL SERVOVALVE

[75] Inventor: Donald B. Mears, Jr., Enfield, Conn.

[73] Assignee: EVC, Inc., Enfield, Conn.

[21] Appl. No.: 555,578

[22] Filed: Jul. 19, 1990

[51] Int. Cl.[5] ..... F15B 13/044

[52] U.S. Cl. ..... 251/65; 137/625.65; 251/129.01; 310/13

[58] Field of Search ..... 137/625.65; 251/65, 251/129.01; 310/13

[56] References Cited

U.S. PATENT DOCUMENTS

| | | | |
|---|---|---|---|
| 3,099,280 | 7/1963 | Holzbock | 137/625.65 X |
| 3,439,198 | 4/1969 | Lee | 310/13 |
| 4,040,445 | 8/1977 | McCormick | 137/625.65 X |
| 4,250,922 | 2/1981 | Will et al. | 137/625.65 |
| 4,316,599 | 2/1982 | Bouvet et al. | 137/625.65 X |
| 4,530,374 | 7/1985 | Akagi et al. | 251/65 X |
| 4,535,816 | 8/1985 | Feder et al. | 137/625.65 |

*Primary Examiner*—Gerald A. Michalsky
*Attorney, Agent, or Firm*—Wolf, Greenfield & Sacks

[57] ABSTRACT

The moving drive portion of the force motor for an electromechanical servovalve is mechanicalkly constrained by slide bearing located on either side of the moving part to prevent it from rubbing against nonmoving parts, in turn, causing early failure and reliability problems. The connection between the force motor and the servovalve is adjustable to allow both the force motor to be electrically centered and the servovalve to be mechanically centered.

23 Claims, 3 Drawing Sheets

ELECTROMECHANICAL SERVOVALVE

FIELD OF THE INVENTION

This invention relates to an electromechanical servovalve in which an electrical current is converted to a mechanical movement in order to actuate a mechanical pilot or servo valve.

BACKGROUND OF THE INVENTION

In many mechanical and hydraulic systems it is often desirable to control the system by means of electrical signals. Consequently, in systems which operate with either compressed air or pressurized oil, it is necessary to provide an electromagnetic transducer which converts the electrical signal into a controlled fluid pressure which then actuates the mechanical equipment. One such transducer is a conventional electromechanical servovalve in which the electrical signals are converted into a mechanical force which, in turn, moves a mechanical valve to control the flow of fluid through the valve. It is especially desirable to make the mechanical movement of the valve directly proportional to the magnitude of the electrical signal which is applied to the valve so that a precise proportional control can be obtained.

Numerous prior art devices have been devised to convert an electrical signal into a proportional mechanical movement for operating a mechanical valve. However, such prior art devices suffer from several problems. For example, many of these devices are relatively complicated and, thus, are fragile and expensive to manufacture. The electromagnetic transducer in other prior art devices is difficult to seal properly to exclude pressurized fluid which leaks from the valve mechanism due to manufacturing tolerances and wear.

One relatively simple prior art device disclosed in U.S. Pat. No. 4,040,445, utilizes an electrical "voice coil" drive to directly actuate a mechanical servovalve, thus simplifying the valve construction. The same device also utilizes metal bellows to isolate the force transducer from the valve to prevent contamination by leaking fluid. This device overcomes some of the aforementioned problems, but it has a limited lifetime and reliability problems. More particularly, it has been found that after a relatively short operating time, the device either jams or becomes electrically shorted and nonfunctional.

In addition, it has been found that the aforementioned prior art servovalve is difficult to adjust. More particularly, such an electromechanical servovalve must be adjusted so that the force transducer is electrically centered and the mechanical valve portion is mechanically centered. In the disclosed device, the mechanical valve mechanism is attached directly to the electromechanical force motor. Consequently, any adjustment must be a compromise between centering the servovalve and centering the electromechanical force motor. Such a compromise often causes inefficient operation and gives rise to nonlinearities in that the force transducer is not precisely centered when the mechanical valve is in its neutral position.

Accordingly, it is an object of the present invention to provide an electromechanical servovalve which is simple in construction.

It is another object of the present invention to provide an electromechanical servovalve which is reliable in operation and has a long life.

It is still another object of the present invention to provide an electromechanical servovalve in which the operation of the valve is proportional to the electrical signals applied to the force transducer.

It is still another object of the present invention to provide an electromechanical servovalve in which the operation of the valve is linear with respect to the electrical signals applied to the force transducer.

It is yet another object of the present invention to provide an electromechanical servovalve which is resistant to jamming or shorting.

It is a further object of the present invention to provide an electromechanical servovalve which utilizes a voice coil electromagnetic force motor.

It is still a further object of the present invention to provide an electromechanical servovalve in which the force transducer and the servovalve can be adjusted separately.

SUMMARY OF THE INVENTION

The foregoing objects are achieved and the foregoing problems are solved in one illustrative embodiment of the invention in which the moving drive portion of the force transducer is mechanically constrained to prevent it from rubbing against nonmoving parts, in turn, causing early failure and reliability problems.

More particularly, it has been discovered that many of the shortcomings of prior art valves utilizing voice coil drives are due to a lack of mechanical constraint applied to the moving drive portion. Consequently, during valve operation, the electromagnetic forces that move the drive portion also act to twist it. This twisting motion causes the drive portion to rub against the force transducer housing eventually jamming the assembly or wearing away the insulation.

The inventive construction prevents twisting of the drive portion by means of slide bearings which are rigidly attached at both the front and rear of the moving portion. The bearings constrain the drive portion to move in a line and prevent the drive portion from twisting due to electromagnetic forces.

In addition, the connection between the force transducer and the servovalve is adjustable so that force transducer can be adjusted independently from the servovalve.

DETAILED DESCRIPTION OF THE PREFERRED EMBODIMENTS

Figure 1:
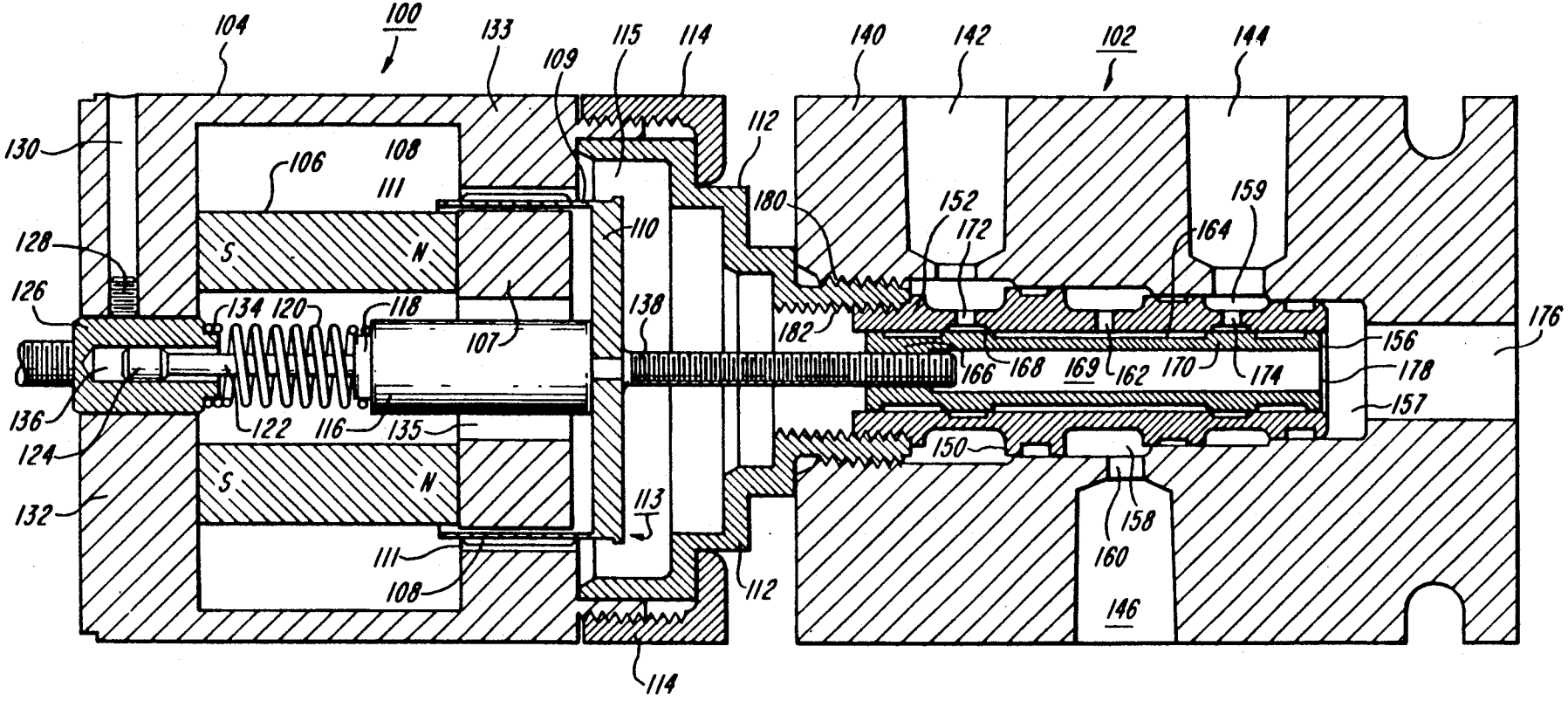
FIG. 1 shows a partial cross sectional view of an illustrative embodiment of the inventive servovalve which is suitable for use with compressed air or other operating fluids which do not require the force transducer to be sealed.

The illustrative embodiment shown in FIG. 1 consists of an electromagnetic force transducer or force motor assembly collectively designated by numeral 100 and a mechanical servovalve assembly collectively designated by numeral 102. Force motor 100 utilizes a conventional voice coil electromagnetic motor construction in which an electrical winding is positioned in a magnetic field, so that an electromagnetic force is created by a current running through the winding.

More particularly, force motor 100 consists of a cylindrical housing 104 which encloses a magnet 106. Illustratively, magnet 106 is a cylindrical permanent magnet polarized as shown in FIG. 1. Without departing from the spirit and scope of the invention, magnet 106 may also be an electromagnet with windings that are energized by passing a current through them.

Magnet 106 is mounted by conventional means to an end wall 132 of housing 104 which closes the housing. Housing 104 is illustratively fabricated from a magnetically permeable material, so that it forms part of a magnetic circuit with magnet 106. The end of magnet 106 opposite wall 132 is attached to an annular ring 107 which is also comprised of magnetically permeable material. Housing 104, magnet 106 and ring 107 form a complete magnetic circuit which channels the magnetic flux generated by magnet 106 through a gap 111 between ring 107 and shoulder 133 of housing 104. The force transducer housing assembly is completed by a cap 112 which slides into a circular recess 115 in shoulder 133. Cap 112 is secured to housing 104 by a means of a screw ring 114, which engages threads cut into the outside of housing 104.

Located within gap 111 is an electrical "voice" coil 108, which is supported on a cylindrical support 109. Support 109 slides over ring 107 and the free end of magnet 106. In a conventional manner, electrical fields generated by current running through the wires in coil 108 interact with the magnetic flux in gap 111 to cause motion of the voice coil. The direction of motion depends on the electrical current direction. Voice coil support 109 is fabricated as part of, or connected to, a header 110 which conveys the motion of coil 108 to the mechanical servovalve. Support 109 and header 110 together form a voice coil "cup" which is collectively designated as cup 113.

As previously mentioned, the interaction of current running through coil 108 with the magnetic flux in gap 111 tends to twist voice coil cup 113 out of linear alignment. Since gap 111 must be narrow to generate the large forces necessary to rapidly move voice coil cup 113, any such twisting motion may cause windings 111 to rub against housing 104. This physical contact traps particles of dirt between winding 108 and housing 104 which eventually cause voice coil cup 113 to jam. Alternatively, the contact wears away the electrical insulation on winding 108 and eventually causes winding 108 to short circuit.

In accordance with the invention, voice coil cup 113 is mechanically constrained to move in a linear direction by a pair of slide bearings. More particularly, header 110 is connected to a tailstock 116, which passes through a cylindrical opening 135 in ring 107. Tailstock 116 has a shaft 122 affixed thereto which contains a slide bearing 124 at the end distal to header 110. Bearing 124, in turn, slides in a bore 136 in journal assembly 126 which is mounted in end wall 132 of housing 104.

Cup header 110 is also connected by means of threaded shaft 138 to servovalve mechanism 102. Valve mechanism 102 consists of body 140, valve insert 152 and a sliding valve spool 156. Valve body 140 has a machined cavity 157 into which insert 152 fits. The outer surfaces of insert 152, together with the inner surface of cavity 157, form channels which control fluid flow as will hereinafter be described. Valve body 140 screws onto a threaded nipple 181 of force motor cap 112 and insert 152 is held in body 140 by internal threads 182 of cap 112.

Since spool 156 is connected to header 110 by shaft 132 and slides in a bore 164 of insert 152, header 110 is also constrained by spool 156 to move linearly. Thus, tailstock 116 and header 110 are free to move in an axial direction, but slide bearing 124 and spool 156 prevent voice coil cup 113 from twisting. Since the bearing points are located at a substantial distance from voice coil cup 113, they provide a large mechanical moment to prevent twisting of cup 113. Accordingly, prior art problems caused by such twisting are thereby eliminated.

The flow of fluid through valve 102 is controlled by the axial position of spool 156 in insert 152. Specifically, valve body 140 is illustratively provided with three fluid ports—inlet port 146 and two outlet ports 142, 144. Other arrangements of ports and spool construction may also be provided without departing from the spirit of the invention Port 146 is connected to a supply of pressurized air or other fluid, which is to be controlled by valve 102. Ports 142 and 144 are connected to other mechanisms (not shown) which utilize the controlled fluid flow. Although ports 142–146 are shown as tapered, they may have straight sides or may be threaded to accept conventional fluid couplings.

Insert 152 fits into cavity 157 of body 140 and divides cavity 157 into three main channels, 150, 158 and 159. Channels 150, 158 and 159 are formed by raised lands on the outer surface of insert 152 which fit tightly against the inner surface of cavity 157. Channel 150 communicates with port 142 by means of orifice 172; channel 158 communicates with port 146 by means of orifice 160 and channel 159 communicates with port 144 by orifice 174. Channel 158 also communicates with the internal bore 164 in insert 152 by means of orifice 162. The outer diameter of spool 156 is in general less than the inner diameter of bore 164 so that fluid can flow in the space between insert 152 and spool 156. However, spool 156 is provided with two raised rings 168 and 170 which have an outer diameter that closely matches the inner diameter of insert 152, thereby, preventing passage of the fluid by the rings. Consequently, the axial position of spool 156 controls fluid flow.

During valve operation, fluid entering inlet port 146 passes by means of orifice 160 into the annular space 158. From annular space 158, the fluid passes through orifice 162 to the angular space 164 between insert 152 and spool 156. From space 164, fluid may pass either through orifice 172 and exit via outlet port 142, or may pass through orifice 174 and exit via outlet port 144. Passage of fluid through orifices 172 and 174 is controlled by the position of spool rings 168 and 170 relative to orifices 172 and 174. In FIG. 1, spool 156 is shown in its neutral position in which rings 168 and 170 completely cover orifices 172 and 172, respectively. In this position, no fluid passes through the valve mechanism. If spool 156 moves towards the right of FIG. 1, ring 70 gradually uncovers orifice 174, allowing fluid to pass from inlet 146 to outlet 144. Fluid is prevented from passing through orifice 172 by ring 168. Alternatively, if spool 156 moves to the left of FIG. 1, ring 168 uncovers orifice 172 such that fluid entering inlet 146 passes through the mechanism to outlet port 142 and ring 170 closes outlet port 174. Thus, fluid entering inlet port 146 may be shifted from one outlet port to the other by the position of spool 156.

The inventive construction allows independent adjustment of force motor assembly 100 and servovalve 102. Illustratively, tailstock 116 is connected, by means of spring 120, to journal assembly 126. More specifically, tailstock 116 is machined to create a recess or shoulder 118 in its end distal to header 110. Spring 120 is fastened to shoulder 118 either by means of epoxy cement or by forming threads (not shown) in shoulder 118 and screwing spring 120 over the threads. In a similar manner, journal assembly 126 has a shoulder 134 formed in it to which the remaining end of spring 120 is fastened. Consequently, although the voice coil cup 113 can slide axially, in the absence of an electromagnetic force, spring 120 maintains voice coil cup 113 at a predetermined distance from journal 126 and housing end wall 132.

Consequently, during valve setup, windings 108 may be electrically centered in the gap between magnet 106 and housing 104 by adjusting the axial position of journal 126. After the electrical center is found by conventional means, journal 126 is fixed in position by tightening set screw 128 against journal 126 via access hole 130.

Figure 2:
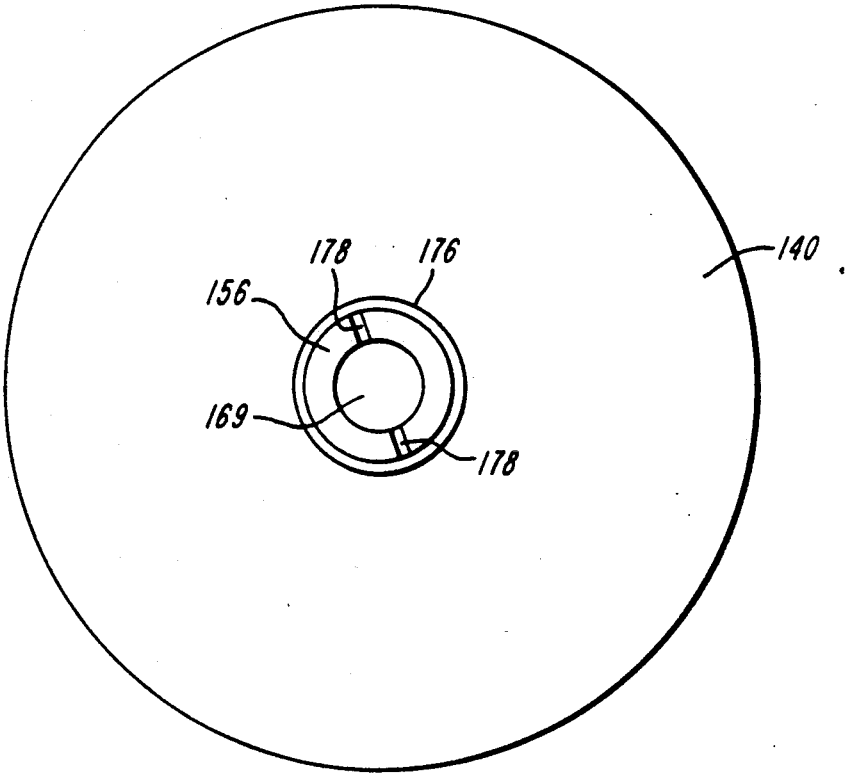
FIG. 2 is an end view of the valve portion of the FIG. 1 embodiment illustrating an adjustment port for adjusting the servovalve.

After voice coil cup 113 has been centered within the magnetic gap, spool 156 is adjusted to its neutral position to complete the adjustment of the valve. To adjust valve 102, compressed fluid is applied to inlet port 146 and an adjustment tool is inserted through exhaust port 176 in body 140. As shown in FIG. 2, the adjustment tool (which may be a screwdriver) can be inserted a slot 178 in the end of spool 156. The entire spool 156 can then be rotated, causing it to move axially due to the fact that it is threaded onto rod 138 which fits into bore 169 and threads into threads 166 The axial position is adjusted until no fluid exits from either outlet port 142 or outlet port 144. When the valve is used for pneumatic or similar applications, after the valve has been adjusted, a muffler or similar device may be attached to port 176 to complete the valve mechanism or the port may simply be left open to prevent pressure from developing in the valve body.

Figure 3:
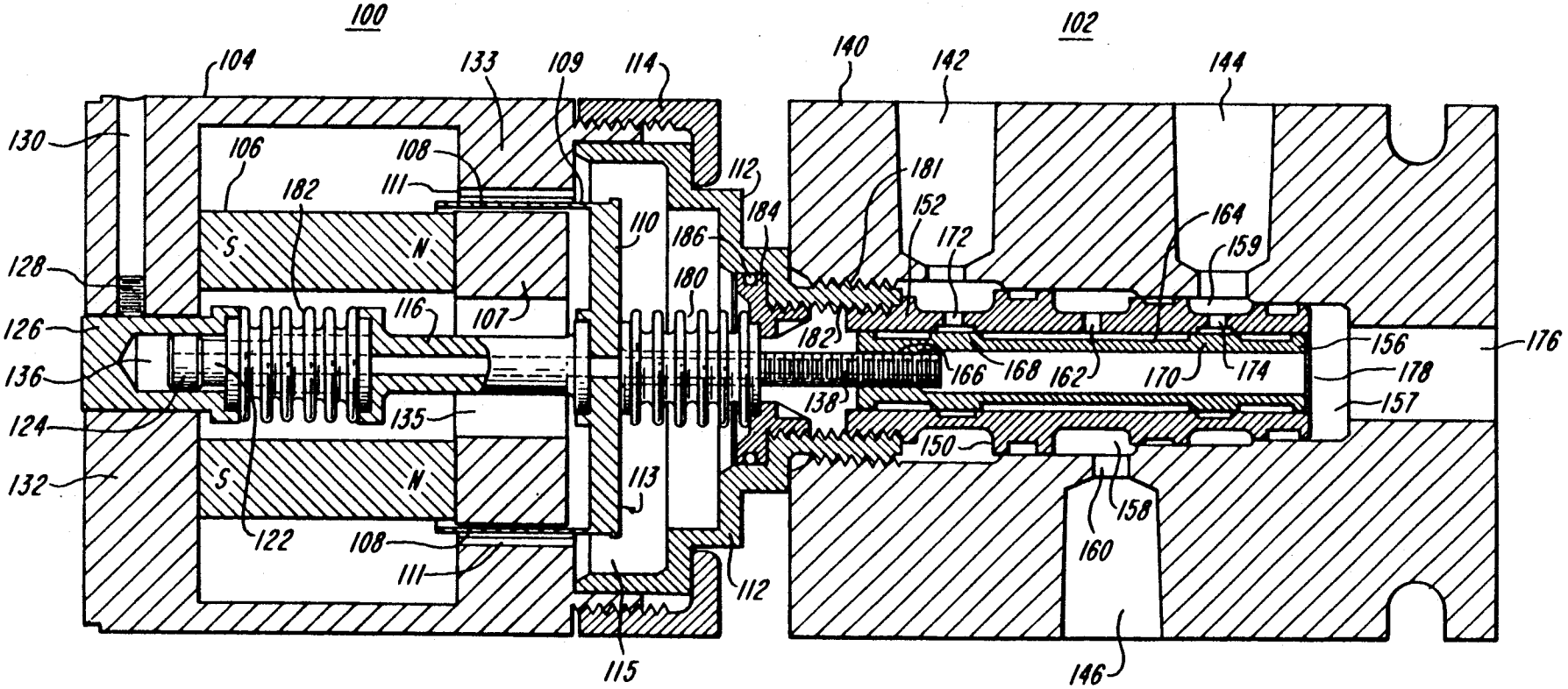
FIG. 3 shows a partial cross-sectional view of another illustrative embodiment which is suitable for use in systems which utilize hydraulic oil or which require a sealed force transducer mechanism.

FIG. 3 is an alternative embodiment of the inventive construction which is suitable for use in environments in which the force motor mechanism must be isolated from the valve mechanism. Such environments may include, for example, systems which use high-pressure hydraulic oil that tends to leak from the valve mechanism or contaminated environments in which dirt may enter the force motor mechanism. Parts which correspond between FIGS. 1 and 3 have been given like numeral designations. As shown in FIG. 3, the valve mechanism 102 is essentially equivalent to that shown in FIG. 1.

The basic construction of force motor 100 is similar to that shown in FIG. 1, but, force motor 100 has been modified to incorporate two expandable metallic bellows 180 and 182 which isolate voice coil cup 113 from the valve mechanism. Bellows 180 and 182 also take the place of spring 120 and center voice coil cup 113. Consequently, they are formed of a spring material, such as phosphor bronze or a plastic material. One end of bellows 180 is attached to header 110 of voice coil cup 113 by means of bonding, soldering or another hermetic sealing arrangement. The other end of bellows 180 is hermetically attached to a sealing insert 184. Insert 184 is threaded onto the internal threads 182 of cap 112, and forms a seal against the inside wall of nipple 181 by means of an elastomeric 0 ring 186. Contaminants from valve mechanism 102 are thereby prevented from entering into force motor mechanism 100.

A second spring bellows 182 provides an even spring loading when the voice coil cup moves in either the left or the right direction. Bellows 182 is connected to tailstock 116 and to journal 126 by means of bonding or soldering. Shaft 122 which terminating in bearing 124 that slides in bore 136 passes through bellows 182.

In the case of a hydraulically operated valve, port 176 (which functions as an exhaust port in pneumatically-operated valves) may be attached to a return line (not shown) which returns hydraulic fluid from the valve to a fluid reservoir (not shown). In a conventional manner, a double acting check valve (not shown) may also be added in series with port 176 and the return line to prevent a pressure build up on bellows 180 if the pressure in the fluid reservoir should happen to become positive.

Although two illustrative embodiments of the invention have been disclosed, that disclosure is intended by way of example only and should not be considered limiting. Additions, changes and modifications and other embodiments will be immediately apparent to those skilled in the art. For example, although the illustrative embodiments use a simple mechanical spool valve, other conventional vale arrangements could easily be substituted. In addition, although the servovalve mechanism in the illustrated embodiments acts as a second slide bearing, a separate slide bearing can be added if a different valve mechanism is used. These changes and modifications are intended to be covered by the claims below.

What is claimed is:

1. A force motor for an electromechanical servovalve comprising:

a housing;

means in said housing for generating a magnetic flux;

an electrical winding;

means for positioning said electrical winding in said flux, said electrical winding carrying current which interacts with said magnetic flux to generate an electromagnetic force which moves said positioning means and said electrical winding along an axis, said positioning means comprising means for supporting said electrical winding and means for resiliently locating said supporting means at a predetermined position in said flux in the absence of current running through said electrical winding;

a first slide bearing located on said axis and rigidly attached to said positioning means;

a second slide bearing means located on said axis and rigidly attached to said positioning means, said positioning means being located on said axis between said first slide bearing and said second slide bearing so that said positioning means is prevented from twisting due to said electromagnetic force; and means for adjusting said resilient locating means along said axis to change the predetermined position.

2. A force motor according to claim 1 wherein said resilient locating means is a spring.

3. A force motor according to claim 1 wherein said resilient locating means is a metal bellows.

4. A force motor according to claim 1 wherein said supporting means is a voice coil cup.

5. A force motor according to claim 1 wherein said first slide bearing comprises a shaft connected to said positioning means and a first journal located on said axis, said first journal having a bore therein in which said shaft slides.

6. A force motor according to claim 1 wherein said second slide bearing comprises a shaft connected to said positioning means and a journal located on said axis, said journal having a bore therein in which said shaft slides.

7. An electromechanical servovalve comprising:

a housing;

means in said housing for generating a magnetic flux;

an electrical winding;

means for positioning said electrical winding in said flux, said electrical winding carrying current which interacts with said magnetic flux to generate an electromagnetic force which moves said positioning means and said electrical winding along an axis, said positioning means comprising means for supporting said electrical winding and means for resiliently locating said supporting means at a predetermined position in said flux in the absence of current running through said electrical winding;

a first slide bearing attached to said housing and located on said axis and rigidly attached to said positioning means;

a second slide bearing attached to said housing and located on said axis and rigidly attached to said positioning means, said positioning means being located on said axis between said first slide bearing and said second slide bearing so that said positioning means is prevented from twisting due to said electromagnetic force;

means for adjusting said resilient locating means along said axis to change the predetermined position; and a servovalve connected to said positioning means, said servovalve being controlled by motion of said positioning means.

8. A servovalve according to claim 7 wherein said resilient locating means is a spring.

9. A servovalve according to claim 7 wherein said resilient locating means is a metal bellows.

10. A servovalve according to claim 7 wherein said supporting means is a voice coil cup.

11. A servovalve according to claim 7 wherein said first slide bearing comprises a shaft connected to said positioning means and a first journal located on said axis and attached to said housing, said first journal having a bore therein in which said shaft slides.

12. A servovalve according to claim 7 wherein said servovalve comprises a body attached to said housing, said body having a cavity therein and a sliding spool located on said axis, said spool sliding in said cavity, and wherein said second slide bearing comprises a shaft connected to said positioning means and to said spool.

13. A servovalve according to claim 12 wherein said shaft has an adjustable length.

14. A servovalve according to claim 7 further comprising a metal bellows connected to said positioning means and to said housing for isolating said positioning means from said servovalve.

15. A servovalve according to claim 7 wherein said magnetic flux generating means comprises a magnet.

16. An electromechanical servovalve comprising:

a housing;

a magnet attached to said housing for generating a magnetic flux;

a voice coil cup having an electrical winding thereon, said voice coil cup being positioned in said magnetic flux, said electrical winding carrying current which interacts with said magnetic flux to generate an electromagnetic force which moves said voice coil cup along an axis;

means for resiliently locating said voice coil cup at a predetermined position in said flux in the absence of current running through said electric winding;

a first slide bearing comprising a rigid shaft connected to said cup and a journal located on said axis and attached to said housing, said journal having a bore therein in which said shaft slides, said journal being slidable with respect to said housing so that the position of said cup with respect to said magnet can be adjusted; and a servovalve having a sliding spool located on said axis and rigidly attached to said cup, said cup being located on said axis between said slide bearing and said servovalve spool so that said positioning means is prevented from twisting due to said electromagnetic force.

17. A servovalve according to claim 16 further comprising a spring connected to said cup and to said journal for resiliently locating said cup at a predetermined position with respect to said housing in the absence of current running through said electrical winding.

18. A servovalve according to claim 17 wherein said journal is slidable with respect to said housing so that the position of said cup with respect to said magnet can be adjusted.

19. A servovalve according to claim 16 further comprising a metal bellows connected to said cup and to said journal for resiliently locating said cup at a predetermined position with respect to said housing in the absence of current running through said electrical winding.

20. A servovalve according to claim 19 wherein said journal is slidable with respect to said housing so that the position of said cup with respect to said magnet can be adjusted.

21. A servovalve according to claim 16 wherein said spool is attached to said cup by an adjustable length shaft.

22. A servovalve according to claim 16 wherein said spool is attached to said cup by a threaded shaft and said body has a port therein through which said spool can be turned on said shaft to adjust the length of the connection between said cup and said spool.

23. A servovalve according to claim 16 further comprising a metal bellows connected to said cup and to said housing between said cup and said servovalve for isolating said cup from said servovalve.

* * * * *